US008216088B2

(12) United States Patent
Hatton et al.

(10) Patent No.: US 8,216,088 B2
(45) Date of Patent: Jul. 10, 2012

(54) GOLF CLUBS AND GOLF CLUB HEADS

(75) Inventors: Philip J. Hatton, Portland, OR (US); Andrew G. V. Oldknow, Beaverton, OR (US)

(73) Assignee: Nike, Inc., Beaverton, OR (US)

( * ) Notice: Subject to any disclaimer, the term of this patent is extended or adjusted under 35 U.S.C. 154(b) by 98 days.

(21) Appl. No.: 12/506,446

(22) Filed: Jul. 21, 2009

(65) Prior Publication Data

US 2011/0021283 A1 Jan. 27, 2011

(51) Int. Cl.
*A63B 53/06* (2006.01)

(52) U.S. Cl. ..... 473/335; 473/342; 473/350

(58) Field of Classification Search ..... 473/334–339, 473/342, 350, 324, 349; D21/733, 747–751
See application file for complete search history.

(56) References Cited

U.S. PATENT DOCUMENTS

| | | | | | |
|---|---|---|---|---|---|
| 1,671,956 | A | * | 5/1928 | Sime | 473/329 |
| D92,266 | S | * | 5/1934 | Nicoll | D21/747 |
| 2,087,685 | A | * | 7/1937 | Hackney | 473/349 |
| D225,123 | S | * | 11/1972 | Viero | D21/749 |
| D243,706 | S | * | 3/1977 | Hall | D21/750 |
| D247,824 | S | * | 5/1978 | Meissler | D21/750 |
| D298,643 | S | * | 11/1988 | Mitsui | D21/750 |
| 5,074,563 | A | * | 12/1991 | Gorman | 473/350 |
| 5,411,264 | A | * | 5/1995 | Oku | 473/329 |
| 5,423,535 | A | * | 6/1995 | Shaw et al. | 473/291 |
| 5,486,000 | A | | 1/1996 | Chorne | |
| 5,584,770 | A | * | 12/1996 | Jensen | 473/350 |
| 5,643,103 | A | * | 7/1997 | Aizawa | 473/290 |
| 5,697,855 | A | * | 12/1997 | Aizawa | 473/350 |
| 5,899,818 | A | * | 5/1999 | Zider et al. | 473/324 |
| 5,938,540 | A | * | 8/1999 | Lu | 473/288 |
| 5,967,903 | A | * | 10/1999 | Cheng | 473/342 |

(Continued)

FOREIGN PATENT DOCUMENTS

WO 2008157655 A1 12/2008

OTHER PUBLICATIONS

Rendall, Jeffrey A., Taylor Made RAC Irons—Finer Sounds Produces Less Fury, GolftheMidAtlantic.com, printed Sep. 24, 2010, 7 pages. http://www.golfthemidatlantic.com/story/232.

FT Hybrids Overview, CallawayGolf.com, printed Sep. 24, 2010, 2 pages. http://www.callawaygolf.com/Global/en-US/Products/Clubs/Hybrids/FTHybrids.html.

(Continued)

*Primary Examiner* — Stephen L. Blau
(74) *Attorney, Agent, or Firm* — Banner & Witcoff, Ltd.

(57) ABSTRACT

A golf club includes a golf club head having a body, a ball-striking face member and one or more mass members. The body extends from a shaft-attachment structure. The ball-striking face member is located on a front surface of the body. The body is configured to releasably accommodate a first mass member in a first region on its back surface and a second mass member in a second region on its back surface. At least one of the first and second mass members may be releasably attached to the back surface. The ball-striking face member may have an average density that is less than the average density of the body. The mass members may have an average density that is more than the average density of the ball-striking face member and/or of the body. The mass distribution of the club head may be customized via the selection and attachment of a particular mass member. The golf club head may be an iron-type golf club head.

8 Claims, 10 Drawing Sheets

U.S. PATENT DOCUMENTS

| | | | | |
|---|---|---|---|---|
| 6,825,315 | B2 * | 11/2004 | Aubert | 528/393 |
| 7,121,956 | B2 * | 10/2006 | Lo | 473/335 |
| D589,107 | S * | 3/2009 | Oldknow | D21/759 |
| 7,578,754 | B2 * | 8/2009 | Nakamura | 473/342 |
| 2002/0082108 | A1 | 6/2002 | Peters et al. | |
| 2003/0157995 | A1 * | 8/2003 | Mahaffey | 473/342 |
| 2005/0107183 | A1 * | 5/2005 | Takeda et al. | 473/326 |
| 2005/0245329 | A1 * | 11/2005 | Nishitani et al. | 473/349 |
| 2005/0250594 | A1 * | 11/2005 | Nishitani et al. | 473/324 |
| 2006/0293114 | A1 * | 12/2006 | Chen | 473/290 |
| 2007/0026965 | A1 * | 2/2007 | Huang | 473/342 |
| 2007/0161433 | A1 * | 7/2007 | Yokota | 473/337 |
| 2009/0239681 | A1 * | 9/2009 | Sugimoto | 473/350 |

OTHER PUBLICATIONS

X-22 Irons Overview, CallawayGolf.com, printed Sep. 24, 2010, 2 pages. http://www.callawaygolf.com/Global/en-US/Products/Clubs/Irons/X-22Irons.html.

PING Golf Clubs: Rapture V2 Technology and Iron Specifications. Printed Feb. 11, 2009: http://www.ping.com/clubs/ironsdetail.aspx?id=3652.

International Search report and Written Opinion issued Dec. 9, 2010 in related PCT Application No. PCT/US2010/042415.

* cited by examiner

GOLF CLUBS AND GOLF CLUB HEADS

FIELD OF THE DISCLOSURE

The present disclosure relates to golf clubs and golf club heads. Particular example aspects of this disclosure relate to iron-type golf clubs and iron-type golf club heads having a lightweight face.

BACKGROUND

Golf is enjoyed by a wide variety of players—players of different genders, ages and/or skill levels. However, one thing that all golfers have in common is a desire to improve their performance, lower their golf scores, and reach that next performance "level." Manufacturers of all types of golf equipment have responded to these demands, and in recent years, the industry has witnessed dramatic changes and improvements in golf equipment, whether to the golf ball, the golf club, or golfing paraphernalia such as shoes, gloves, etc. For example, golf clubs have been the subject of much technological research and advancement in recent years and a wide range of different golf club models are now available. Clubs and individual club components (golf club heads, shafts, hosels, grips, etc.) have been designed to complement specific swing speeds and/or other player characteristics or preferences, e.g., with clubs designed to make the golf ball fly farther, straighter, faster, slower, higher, flatter, with more spin, with less spin, with more control, with greater "feel"; etc. Additionally, other technological advancements have been made in an effort to better match the various characteristics of the golf club and golf club components to a particular user's swing features or characteristics (e.g., club fitting technology, ball launch angle measurement technology, ball spin rates, etc.).

Golf clubs have traditionally been categorized as drivers or woods, irons and putters, although the distinctions have become blurred with the more recent introduction of hybrid golf clubs. As compared to woods, irons are used for making relatively short, high-trajectory shots, such as for shots approaching the green or from more difficult lies such as from the rough, through or over trees, or the base of hills. Irons feature relatively thin, metal, club heads. They have a flat angled face and a shorter shaft than a wood. Typically, the face of an iron will be horizontally grooved to impart spin.

Standard irons are numbered from 1 to 9. The higher the number, the higher the loft, i.e., the greater the angle difference between the face of the club head and the axis of the club shaft. A 1-iron is typically lofted at about 15 to 18 degrees; a 9-iron is typically lofted at about 41-46 degrees.

Higher loft irons, i.e. irons with a higher loft than a 9-iron, may also be referred to as wedges. Wedges are used for a variety of short-distance, high-altitude, high-accuracy shots such as hitting the ball onto the green, placing the ball accurately on the fairway for a better shot at the green, or hitting the ball out of hazards or rough onto the green. Wedges may have lofts ranging up to about 60 degrees.

Two common styles of iron-type club heads are available: the traditional "blade" style and the more modern "cavity back" style. The blade-style features a full back on the rear of the club head, whereas the cavity back-style features, at least to a certain degree, a hollowed out back. The cavity back-style creates an effect known as "perimeter weighting," which allows more of the club head weight to be placed around the edges of the club head, leaving the center with less material. This added mass is designed to reduce the amount of club twist (by increasing the club head's moment of inertia) when the ball is struck towards the edge of the club, rather than in its center. This results in an increase in the size of the effective hitting area, i.e., the "sweet spot."

While the industry has witnessed dramatic changes and improvements to golf equipment in recent years, some players continue to experience difficulties in reliably hitting a golf ball in an intended direction and with an intended ball flight.

Accordingly, there is room in the art for further advances in golf club technology.

SUMMARY

The following presents a general summary of aspects of the disclosure in order to provide a basic understanding of the disclosure and various aspects of it. This summary is not intended to limit the scope of the disclosure in any way, but it simply provides a general overview and context for the more detailed description that follows.

Golf clubs according to at least some example aspects of this disclosure include: a golf club head having a body, a ball-striking face member and one or more mass members. The body may extend from a shaft-attachment structure. The ball-striking face member may be located on a front surface of the body. The body may be configured to releasably accommodate a first mass member on its back surface and a second mass member on its back surface. At least one of the first and second mass members may be attached to the back surface. The ball-striking face may have an average density that is less than the average density of the body. The mass members may have an average density that is more than the average density of the body. Thus, the mass distribution of the club head may be customized via the selection of a particular ball-striking face member and particular mass members. The golf club head may be an iron-type golf club head.

According to other aspects, a golf club head may include an iron-type body extending from a heel region to a toe region. The ball-striking face member may be located on a front surface of the body. The body may have a mass member accommodating feature on its back surface for releasably accommodating a first mass member having a first shape. The mass member accommodating feature may be located adjacent to the peripheral back-surface edge of the body. The first mass member may be located on the back surface of the body. The ball-striking face member may have an average density that is less than an average density of the body. The average density of the body may be less than or equal to an average density of at least one of the mass members. A second mass member, having a second shape different from the first shape, may be interchangeably accommodated by the body.

According to other example aspects of this disclosure, an iron-type golf club head includes a body extending from a heel region to a toe region, the body having a first average density. The golf club head further includes a ball-striking face member located on a front surface of the body, the ball-striking face member having a second average density. The golf club head may further include one or more mass members attached to the back surface of the body, at least one of the mass members having a third average density. The total mass of the one or more mass members may substantially equals the volume of the ball-striking face member multiplied by the difference between the first average density of the body and the second average density of the ball-striking face member. Thus, in one aspect, the weight of the mass members applied to the rear of the club head may be equal to the weight saved by using a lightweight face member, such that the overall weight of the club head is unchanged from a club head having a constant density.

Additional aspects of this disclosure relate to golf club structures that include golf club heads, e.g., of the types described above. Such golf club structures further may include one or more of: a shaft member attached to the club head (optionally via a separate hosel member or a hosel member provided as an integral part of one or more of the club head or shaft); a grip or handle member attached to the shaft member; etc.

Still additional aspects of this disclosure relate to a system for customizing an iron-type golf club head. The system includes: an iron-type golf club body configured to attach to a golf club shaft; one or more ball-striking face members configured to be located on a front surface of the golf club body; and a plurality of mass members configured to be releasably accommodated on the back of the golf club body. The average density of the ball-striking face member may be less than the average density of the golf club body. The average density of the golf club body may be less than the average density of one or more of the mass members. The body may be configured to accommodate the mass members in regions that extend along at least a portion of the back-surface peripheral edge.

According to even other aspects of this disclosure, a method for customizing the mass distribution of a golf club head includes: providing a golf club body having a first average density and a ball-striking face member having a second average density; providing a first mass member having a third average density greater than the second average density; and locating the first mass member on the back of the golf club body adjacent to a peripheral back-surface edge of the body. The third average density may be greater than the first average density. The method may further include providing a second mass member and locating the second mass member on the back of the golf club body. Other steps also may be included in these methods, such as engaging a shaft member with the golf club head, engaging a grip member with the shaft member, applying a finish to the club head body, etc.

BRIEF DESCRIPTION OF THE DRAWINGS

The present disclosure is illustrated by way of example and not limited in the accompanying figures, in which like reference numerals indicate similar elements throughout, and in which.

Figure 1:
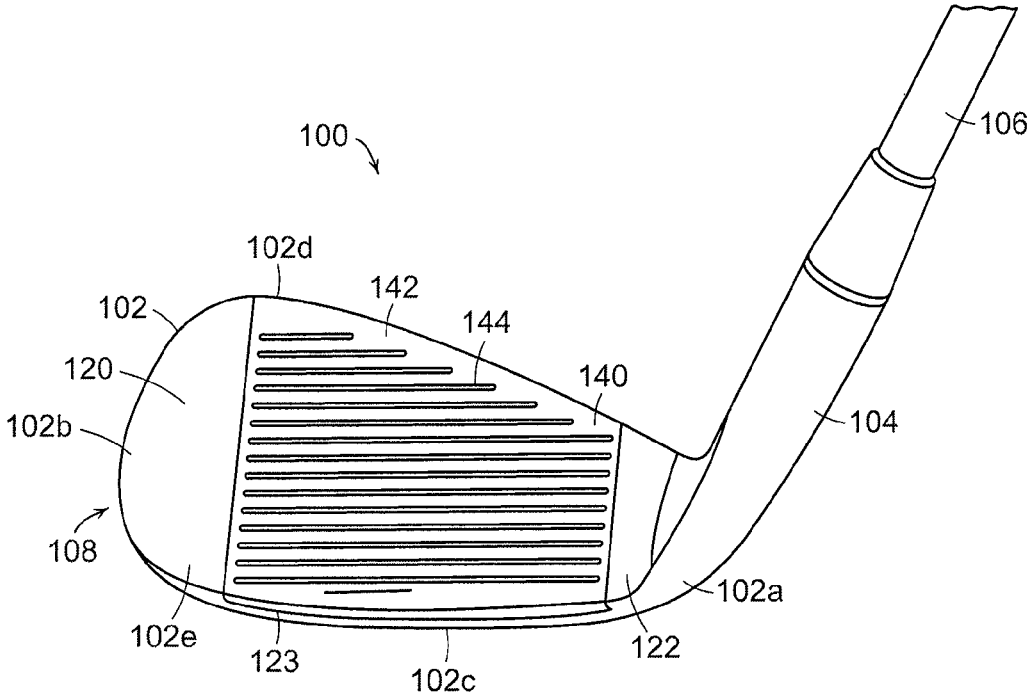
FIG. 1 generally illustrates features of a front view of an iron-type golf club structure according to at least some examples of this disclosure.

The reader is advised that the various parts shown in these drawings are not necessarily drawn to scale.

DETAILED DESCRIPTION

The following description and the accompanying figures disclose features of golf club heads and golf clubs in accordance with examples of the present disclosure.

I. GENERAL DESCRIPTION OF EXAMPLE GOLF CLUB HEADS, GOLF CLUBS, AND METHODS IN ACCORDANCE WITH THIS DISCLOSURE

As described above, aspects of this disclosure relate to golf club heads and golf clubs. Golf club heads according to at least some example aspects of this disclosure may include: (a) a golf club head body; (b) a ball-striking face member; and (c) at least one mass member on the opposite side of the body from the ball-striking face member. The average density of the ball-striking face member may be less than the average density of the body, which may be less than the average density of the mass member.

According to aspects of this disclosure, the weight distribution of a golf club head is improved. For most golfers, it is not easy to hit a golf ball with the classic shaped iron-type clubs. This is because the club heads typically have low moments of inertia and high and shallow centers of gravity. Increasing the moment of inertia of the club head and/or shifting the center of gravity down toward the sole and back away from the face of the club can result in a club providing better performance characteristics.

One way to vary the mass distribution of an iron-type club head is to substitute the traditional materials used to make the club head body with components formed from nontraditional materials. Specifically, according to certain aspects of this disclosure, weight may be reduced at the front face of the iron-type club head by replacing the material traditionally used to form the ball-striking face member with a material having a lower density (i.e., steel could be replaced with titanium). In this manner, the center of gravity of the golf club may be shifted away from the face of the club head.

Furthermore, the weight saved by using a lower density material for the face member may then be strategically placed toward the back of the club head. Thus, the overall weight of the club may remain unchanged, but the center of gravity would be shifted even further from the face of the club. According to this aspect of this disclosure, a mass member having a density higher than the ball-striking face member may be located at the rear surface of the club head. According to even another aspect of this disclosure, a mass member having a density higher than a club head body may be located on the rear surface of the club head.

According to another aspect of the disclosure, the moment of inertia of the club head may also be changed by shifting the center of gravity and/or by distributing the mass closer to or farther way from the center of gravity. Thus, for example, an increase in the moment of inertia may be achieved by shifting weight from the center of the club head to one or more peripheral edges of the club head. This increase may be accomplished without increasing the overall weight of the club head by, for example, providing a lighter weight face member at the front of the club head and strategically locating one or more mass members (equal to the weight saved by using the lighter weight face member) adjacent to a peripheral edge at the back of the club head. According to other aspects of the disclosure, mass members located at the back of the club head need not be equal to the weight saved by using a lighter weight face member. In other words, the total weight of the club head need not be maintained at any particular weight.

The lighter the weight of the ball-striking face member and the heavier the weight of the mass member(s) the more the center of gravity will be shifted away from the face of the club head. This provides an opportunity to customize or individually design the club head and the club head mass distribution to a particular user. Thus, according to certain aspects of this disclosure, a club head body that can accommodate any of a selection of ball-striking face members and/or that can accommodate one or more of a selection of mass members may be provided. The selection of ball-striking face members may include face members having various densities, weights, and/or shapes or construction. Similarly, the selection of mass members may include mass members of various densities, weights and/or shapes. Customizing the club head would entail selecting a ball-striking face member and attaching it to the front surface of the club head body and selecting one or more of the mass members and attaching them toward the rear of the club head body.

The mass distribution features of the golf club heads in accordance with this disclosure are not limited to controlling the front-to-back horizontal position of the golf club's center of gravity (the horizontal position when the golf club is oriented at a ball addressing position). Rather, the center of gravity in the vertical direction also may be selectively controlled, if desired, in at least some examples of golf club head structures according to this disclosure. Increasing the weight in the crown area of the club head (e.g., by providing a mass member closer to the crown), produces a higher center of gravity in the golf club head which can provide a more boring golf ball flight path, e.g., for play in windy conditions, to provide more "running" shots, and/or to help compensate for swing flaws that typically produce an excessively high ballooning flight. Conversely, increasing the weight in the sole area of the club head (e.g., by providing a mass member closer toward the sole), produces a lower center of gravity in the golf club head which can provide a more lofted golf ball flight path, thereby helping a golfer get the ball in the air.

Further, the mass distribution features of the golf club heads in accordance with this disclosure may be used to controlling the heel-to-toe horizontal position of the golf club's center of gravity. Increasing the weight in the heel area of the club head and/or decreasing the weight in the toe area of the club head shifts the center of gravity toward the golf club shaft. This may aid a golfer to impart a "draw" trajectory to the golf ball. Conversely, decreasing the weight in the heel area of the club head and/or increasing the weight in the toe area of the club head shifts the center of gravity away the golf club shaft and toward the toe region. This may aid a golfer to impart a "fade" trajectory to a golf ball.

According to other aspects of the disclosure, the face member can be releasably attached to the body and the mass members can be releasably attached to the body. This provides a simple and efficient system for customizing a club head's mass distribution by letting a user test the performance characteristics of the club head, and, if desired, changing or modifying the mass distribution to further improve the performance characteristics. Upon finalizing the mass distribution of the club head, the face member and/or the mass member(s) may be permanently affixed to the body, if desired.

Additional aspects of this disclosure relate to iron-type golf club structures that include golf club heads of the types described above. Such iron-type golf club structures further may include one or more of: a shaft member attached to the club head (optionally via a separate hosel member or a hosel member provided as a part of one or more of the club head and/or shaft); a grip or handle member attached to the shaft member; center of gravity indicators; etc.

Still additional aspects of this disclosure relate to methods for producing iron-type golf club heads and iron-type golf club structures in accordance with examples of this disclosure. Such methods may include, for example, one or more of the following steps in any desired order and/or combinations: (a) providing a golf club head body for accommodating a face member and one or more mass members; (b) providing a face member and engaging the face member to the body; and (c) providing a mass member and engaging the mass member to the body.

Given the general description of various example aspects of the disclosure provided above, more detailed descriptions of various specific examples of golf clubs and golf club head structures according to the disclosure are provided below.

II. DETAILED DESCRIPTION OF EXAMPLE GOLF CLUB HEADS, GOLF CLUB STRUCTURES, AND METHODS ACCORDING TO THE DISCLOSURE

The following discussion and accompanying figures describe various example golf clubs and golf club head structures in accordance with the present disclosure. When the same reference number appears in more than one drawing, that reference number is used consistently in this specification and the drawings to refer to the same or similar parts throughout.

More specific examples and features of iron-type golf club heads and golf club structures according to this disclosure will be described in detail below in conjunction with the example golf club structures and components illustrated in FIGS. 1-14.

Figure 2:
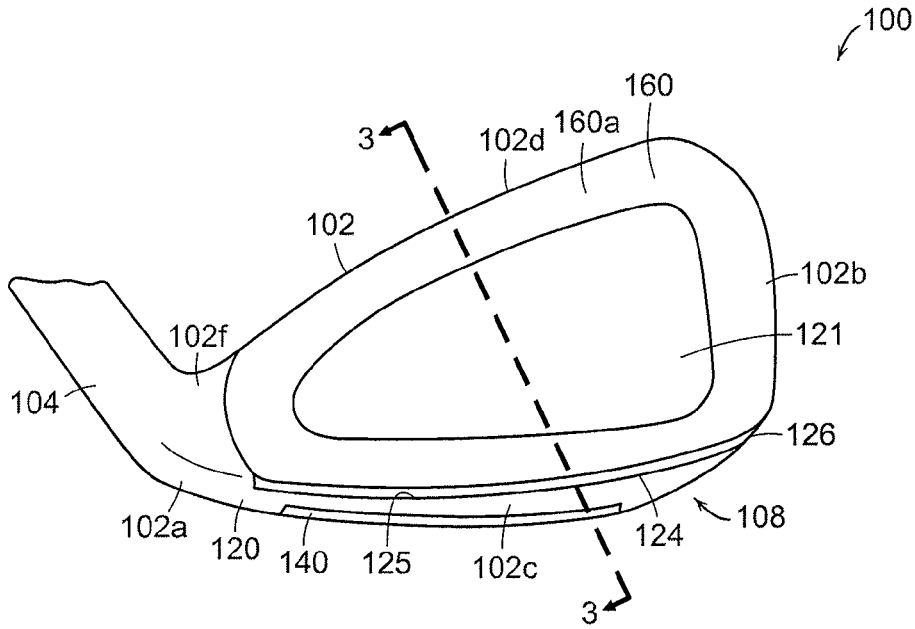
FIG. 2 generally illustrates features of a back view of the golf club structure of FIG. 1 with a first mass member arrangement.
Figure 3:
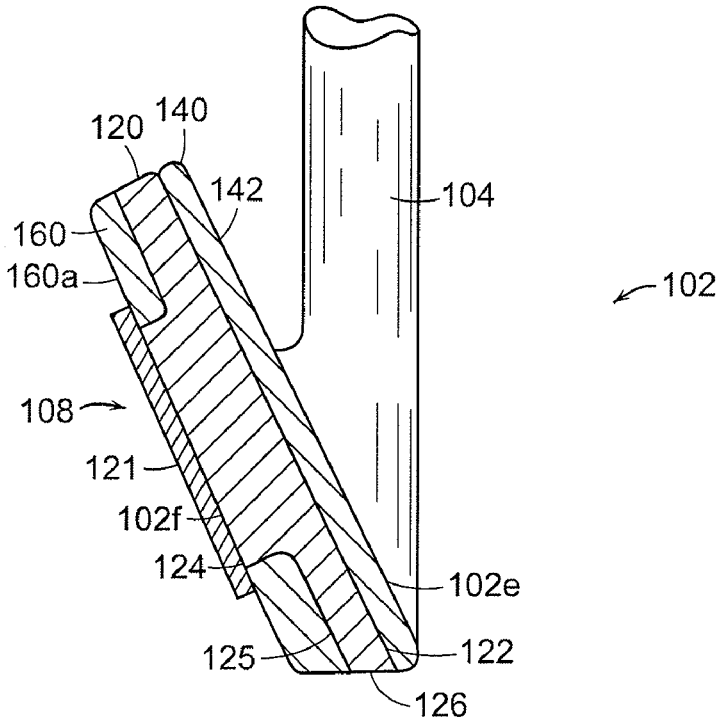
FIG. 3 generally illustrates features of a cross sectional view of the golf club head of FIG. 1.

FIGS. 1-3 generally illustrate an example of an iron-type golf club 100 and/or golf club head body 102 in accordance with the present disclosure. In addition to the golf club head 102, the overall golf club structure 100 of this example includes a shaft member 106 attached at its distal end to the club head 102. A grip or handle member (not shown) may be included at the proximal end of the shaft member 106.

The club head 102 includes a foot structure 108 and a shaft-attachment structure 104 that extends externally upward from the foot structure 108. Typically, the shaft-attachment member 104 is integrally formed with the foot structure 108 as part of the club head 102, but it may be separately formed and engaged therewith (e.g., by adhesives or cements; by welding, brazing, soldering, or other fusing techniques; by mechanical connectors; etc.). The various parts of the club head 102 may be made by forging, casting, molding, and/or using other techniques and processes, including techniques and processes that are conventional and known in the art.

The shaft member 106 may be received in, engaged with, and/or attached to the club head 102 in any suitable or desired manner, including in conventional manners known and used in the art, without departing from the disclosure. As one example, the shaft member 106 may be attached to the shaft-attachment structure 104 via an external hosel or other connector. Optionally, if desired, the shaft-attachment structure 104 may define an internal shaft connection region (not shown), such that the distal end of the shaft member 106 may be inserted into and/or otherwise attached to the club head 102 (e.g., directly through an opening provided in the shaft-attachment structure 104, indirectly through an internal hosel member provided within an interior chamber defined by the shaft-attachment structure 104, etc.). Conventional hosels and their inclusion in an iron-type club head structure may be used without departing from this disclosure.

As examples, the shaft member 106 may be engaged with the club head 102 via a hosel and/or directly to the club head 102 via adhesives, cements, welding, soldering, mechanical connectors (such as threads, retaining elements, or the like), etc.; through a shaft-receiving sleeve or element extending into or from the club head 102; etc. If desired, the shaft member 106 may be connected to the club head 102 in a releasable manner using mechanical connectors to allow easy interchange of one shaft for another on the club head 102.

The shaft member 106 may be made from any desired materials, including conventional materials known and used in the art, such as graphite based materials, composite or other non-metal materials, steel materials (including stainless steel), aluminum materials, other metal alloy materials, polymeric materials, combinations of various materials, and the like. Also, the grip or handle member (not shown) may be attached to, engaged with, and/or extend from the proximal end of the shaft member 106 in any suitable or desired manner, including in conventional manners known and used in the art, e.g., using adhesives or cements; via welding, soldering, brazing, or the like; via mechanical connectors (such as threads, retaining elements, etc.); etc. As another example, if desired, the grip or handle member (not shown) may be integrally formed as a unitary, one-piece construction with the shaft member 106. Additionally, any desired grip or handle member materials may be used without departing from this disclosure, including, for example: rubber materials, leather materials, rubber or other materials including cord or other fabric material embedded therein, polymeric materials, and the like.

The club head 102 includes a foot structure 108 that extends widthwise from a heel region 102*a* to a toe region 102*b* of the club head 102. Further, foot structure 108 extends heightwise from a bottom edge or sole 102*c* to a top edge or crown 102*d* of the club head 102. A front surface 102*e* and a back surface 102*f* of club head 102 further define the foot structure 108.

Figure 6:
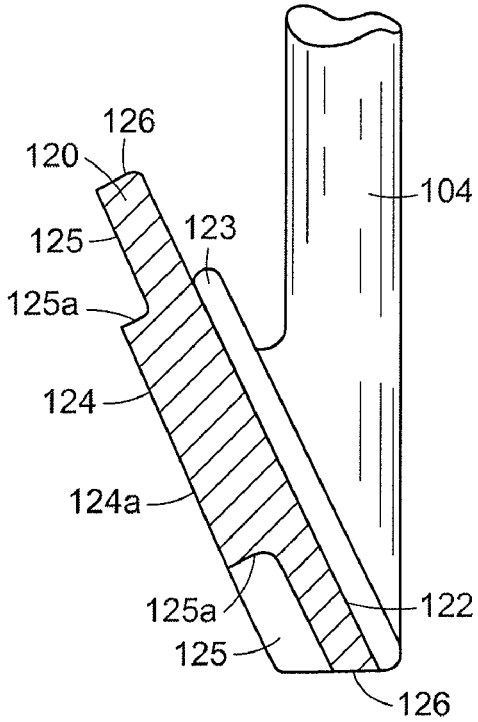
FIG. 6 generally illustrates features of a cross sectional view of the golf club head body of FIG. 4.
Figure 4:
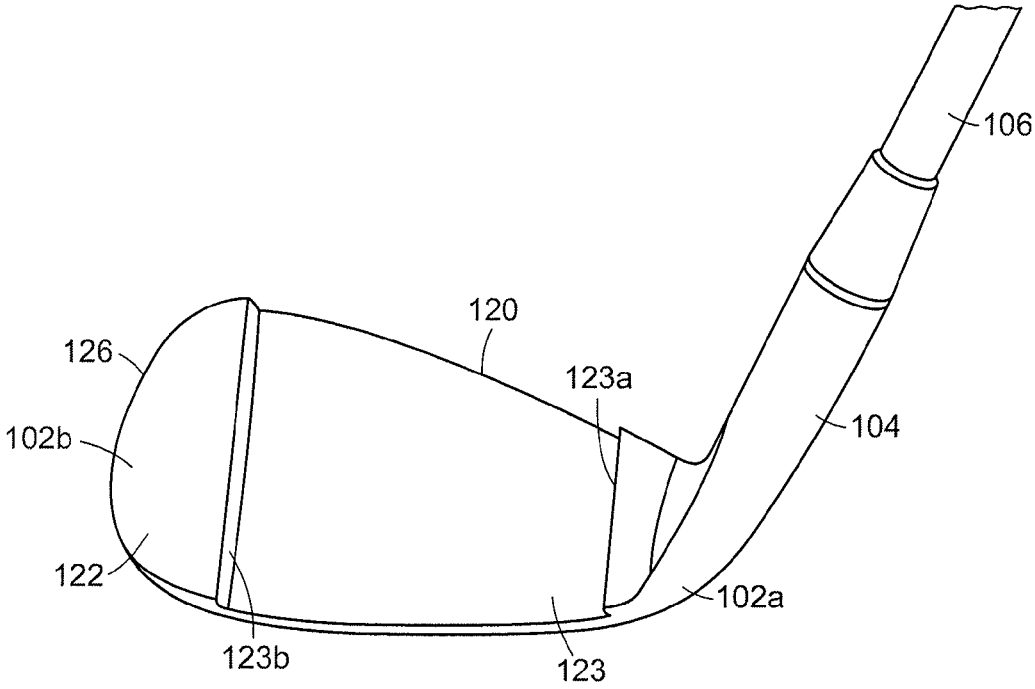
FIG. 4 generally illustrates features of a front view of the golf club head body of FIG. 1.
Figure 5:
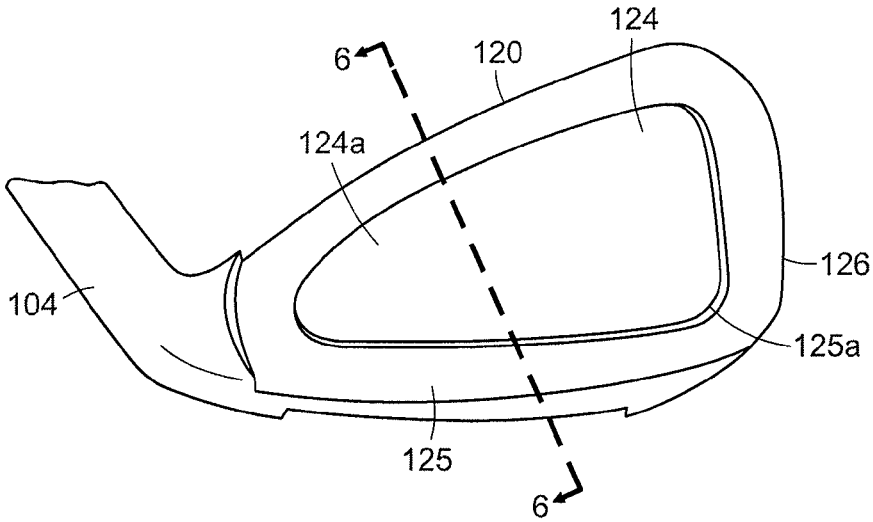
FIG. 5 generally illustrates features of a back view of the golf club head body of FIG. 4.

As best shown in FIGS. 1-3, the foot structure 108 includes a body 120, a ball-striking face member 140, and one or more mass members 160. Referring to FIGS. 4-6, the body 120 extends from the shaft-attachment structure 104 in the heel region 102*a* toward the toe region 102*b* and defines a front surface 122, a back surface 124 and a perimeter 126. Referring back to FIG. 1, the ball-striking face member 140 is located on the front surface 122 of the body 120. Referring to FIG. 2, the one or more mass members 160 are located on the back surface 124 of the body 120.

As shown in FIGS. 4-6, the body 120 of the foot structure 108 may be integrally formed with the shaft-attachment structure 104 that extends externally upward from the body 120. Optionally, the body 120 may be separately formed and engaged with the shaft-attachment structure 104 (e.g., by adhesives or cements; by welding, brazing, soldering, or other fusing techniques; by mechanical connectors; etc.). The body 120 is typically formed from a steel (such as a stainless steel), but may be made from any desired material, including conventional materials known and used in the art, such as aluminum materials or other metal alloy materials, other less conventional materials, such as, polymeric materials, graphite based materials, composite or other non-metal materials, or combinations of these various materials, and the like.

A first average density (D1) is associated with the material(s) used to form the body 120. If the body 120 is formed of a single material, the average density D1 of the body 120 is equal to the density of that material. However, if the body 120 is formed of more than one material, the average density D1 of the body 120 is calculated as the total mass of the body 120 divided by the total volume of the body 120.

Referring back to FIGS. 1 and 3, an example ball-striking face member 140 is shown attached to the front surface 122 of the body 120. The ball-striking face member 140 includes a ball-striking face plate 142 used to impact the golf ball. In this example, the face plate 142 is a solid plate. Optionally, the ball-striking face member 140 may include a frame (not shown) or other stiffeners for the ball-striking face plate 142. The ball-striking face member 140 may be constructed in any suitable or desired manner and/or from any suitable or desired materials without departing from this disclosure, including from conventional materials and/or in conventional manners known and used in the art. By way of non-limiting examples, according to some aspects of this disclosure, the solid face plate 142 may be formed from a single material as a single layer; as multiple layers of the same material joined together, e.g., bonded, cemented, soldered welded, brazed, etc.; as multiple layers of different materials joined together; etc. As other non-limiting examples, the ball-striking face member 140 may be formed as a plate and a frame subsequently integrally joined together (either using the same or different materials for the plate and the frame) or may be unitarily formed as a molded plate/frame assembly. The face plate 142 may further include grooves 144 on its front surface to impart spin to the golf ball upon impact.

A second average density (D2) is associated with the material(s) used to form the ball-striking face member 140. If the ball-striking face member 140 is formed of a single material, the average density D2 of the ball-striking face member 140 is equal to the density of that material. However, if the ball-striking face member 140 is formed of more than one material, the average density D2 of the face member 140 is calculated as the total mass of the face member 140 divided by the total volume of the face member 140.

The ball-striking face member 140 is located on the front surface 122 of the body 120 and may be joined to body 120 in any suitable or desired manner, including using conventional materials and/or in conventional manners known and used in the art. By way of non-limiting examples, the face member 140 may be joined to body 120 by bonding, cementing, soldering, welding, brazing, etc.; by mechanical fastening techniques such as fasteners, interference fits, etc. In the example structure shown in FIGS. 1-3 and referring to FIG. 4, the front surface 122 of the body 120 includes a channel or recessed area 123 for accommodating the ball-striking face member 140. The example recessed area 123 of FIG. 4 includes a first side 123*a* in or adjacent to the heel region 102*a* of the club head 102 and a second side 123*b* in or adjacent to the toe region 102*b* of the club head 102. As shown in FIG. 1, the ball-striking face member 140 extends from the bottom edge 102*c* to the top edge 102*d* of the club head 102. Thus, as shown by this particular embodiment, the ball-striking face member 140 may define a front-surface peripheral top edge of the golf club head and a front-surface peripheral bottom edge of the golf club head. Alternatively, by way of other non-limiting examples (not shown), the recessed area could include sides near the bottom edge 102*c* and/or near the top edge 102*d* of the club head 102 such that the ball-striking face member 140 would be framed by the front surface 122 of the body 120.

Referring back to FIGS. 2 and 3 and further referring to FIG. 5, a mass member 160 is shown attached to the back surface 124 of the body 120. In this example, mass member is represented by mass member 160*a*, which is located adjacent to the peripheral edge or perimeter 126 of the back surface 124 of the body 120. In this context, the term "adjacent to the peripheral edge" means: (1) being in close proximity to, but inboard of, the peripheral edge; (2) extending all the way to the peripheral edge; and/or (3) even extending over and beyond the peripheral edge. For example, a mass member 160 is considered to be located adjacent to a peripheral edge of the body 120 if at least a portion of the mass member 160 is located within a region that extends no more than 10% of the distance from the heel-to-the-toe or from the crown-to-the sole, whichever is the relevant dimension, from the peripheral edge. Thus, if the heel-to-toe dimension is 3.0 inches and if the mass member is within 0.30 inches of the peripheral toe edge, it is considered to be adjacent to the peripheral toe edge.

Referring to FIG. 5, the mass member 160*a* is shown extending along substantially the entire back-surface peripheral edge of the body 120. The back-surface peripheral edge includes the peripheral edge that extends along the crown of the body, down along the toe of the body, and along the sole of body. In the context of this disclosure, the term "substantially" means from 90% to 100% of the total.

The body 120 is configured to accommodate the mass member 160*a* in a first region on the back surface of the body 120. In the particular example shown in FIGS. 2 and 3, the mass member 160*a* is accommodated within a channel or recessed area 125 that extends along substantially the entire back-surface peripheral edge of the body 120. A retaining plate 121 extends partially over mass member 160*a* to assist in retaining mass member 160*a* to the body 120. The retaining plate 121 may be releasably attached to the body 120 using any suitable means (not shown), including threaded fasteners, clips, removable adhesive, etc. Other means, as would be apparent to a person of ordinary skill in the art, given the benefit of this disclosure, may be used to assist in the releasable accommodation of the mass member 160*a* to the back surface 124 of the body 120. Optionally, the mass member 160*a* need not be located within a channel or recess of the body 120. Further, in this particular example, the mass member 160*a* is a solid plate, forming an "annular ring" that extends completely along the perimeter of the body. As best shown in FIG. 3, the mass member 160*a* may include thinner regions (for example, near the top edge) or thicker regions (for example, near the bottom edge) to achieve the desired weight distribution.

Mass members 160 may be constructed in any suitable or desired manner and/or from any suitable or desired materials without departing from this disclosure, including from conventional materials and/or in conventional manners known and used in the art. By way of non-limiting examples, according to some aspects of this disclosure, the mass member 160 may be formed from a single material as a single layer; as multiple layers of the same material joined together, e.g., bonded, cemented, soldered welded, brazed, etc.; as multiple layers of different materials joined together; etc. As another non-limiting example, the mass member 160 may be formed as a plate with strategically placed cut-outs. The cut-outs may allow the mass member to completely fill a channel or recessed area provided in a particular body 120, while at the same time providing the desired mass distribution.

Mass members 160 are releasably accommodated on the back surface 124 of the body 120 and may be joined to body 120 using any suitable or desired mass member accommodating feature, including in conventional manners known and used in the art. By way of a non-limiting example and as described above, according to some aspects of this disclosure, the mass member 160 may be accommodated within a channel that serves to laterally restrict the movement of the mass member 160. In this context, the term "channel" refers to a surface having one or more sides extending upward from the surface. Optionally, when the mass member 160 is accommodated within a channel, the mass member 160 may also extend beyond the confines or boundaries of the channel. The mass member 160 may be releasably joined to body 120 by adhesive bonding and/or by mechanical fastening techniques such as threaded fasteners, interference fits, retainers, etc.

In the example structure shown in FIGS. 2 and 3, the back surface 124 of the body 120 includes a channel or recessed area 125 for accommodating the mass member 160*a*. The example recessed area 125, best shown in FIGS. 5 and 6, includes a side 125*a* encircling a raised central portion 124*a* of the back surface 124 of the body 120. Mass member 160*a* is located within recessed area 125 and extends from the side 125*a* to the perimeter 126 of the body 120 all the way around the raised central portion 124*a*.

Figure 7:
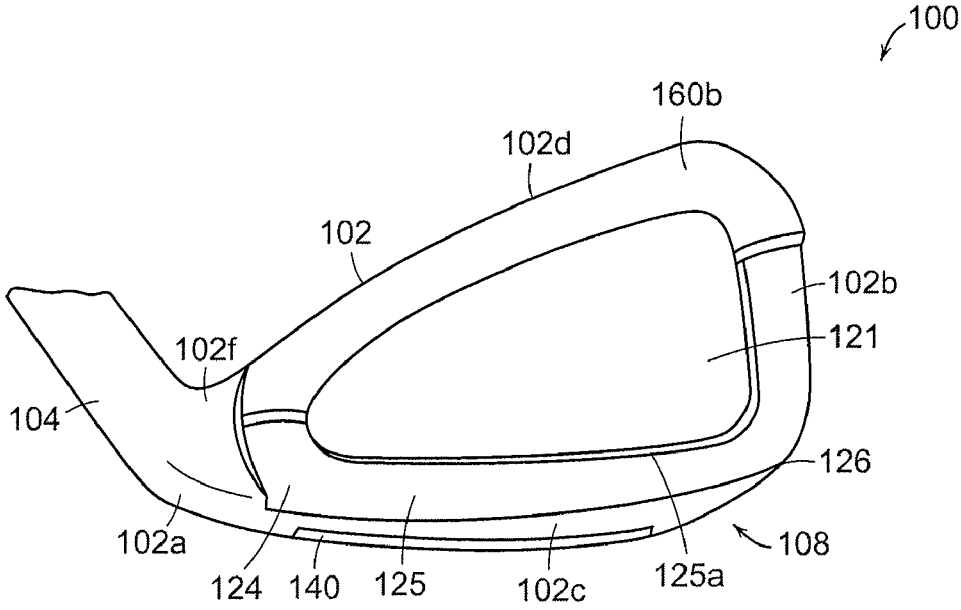
FIG. 7 generally illustrates features of a back view of the golf club structure of FIG. 1 with an alternative mass member arrangement.
Figure 8:
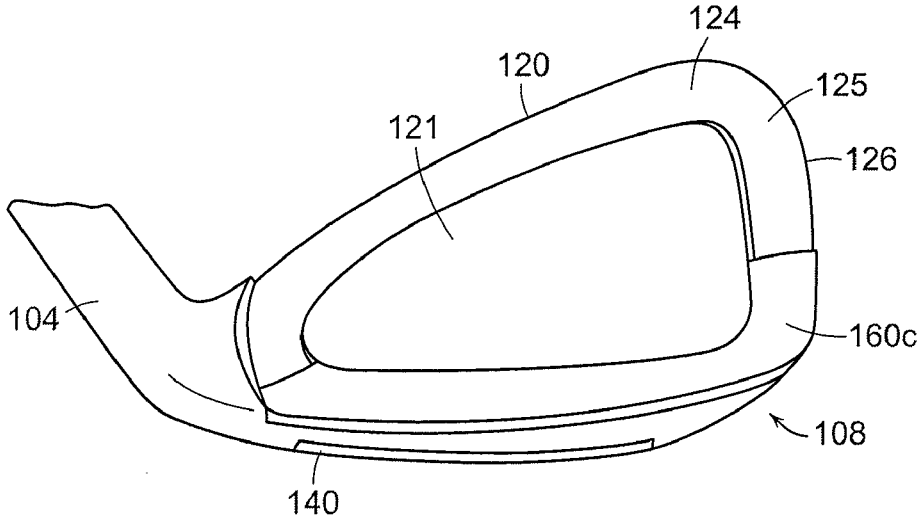
FIG. 8 generally illustrates features of a back view of the golf club structure of FIG. 1 with another alternative mass member arrangement.
Figure 9:
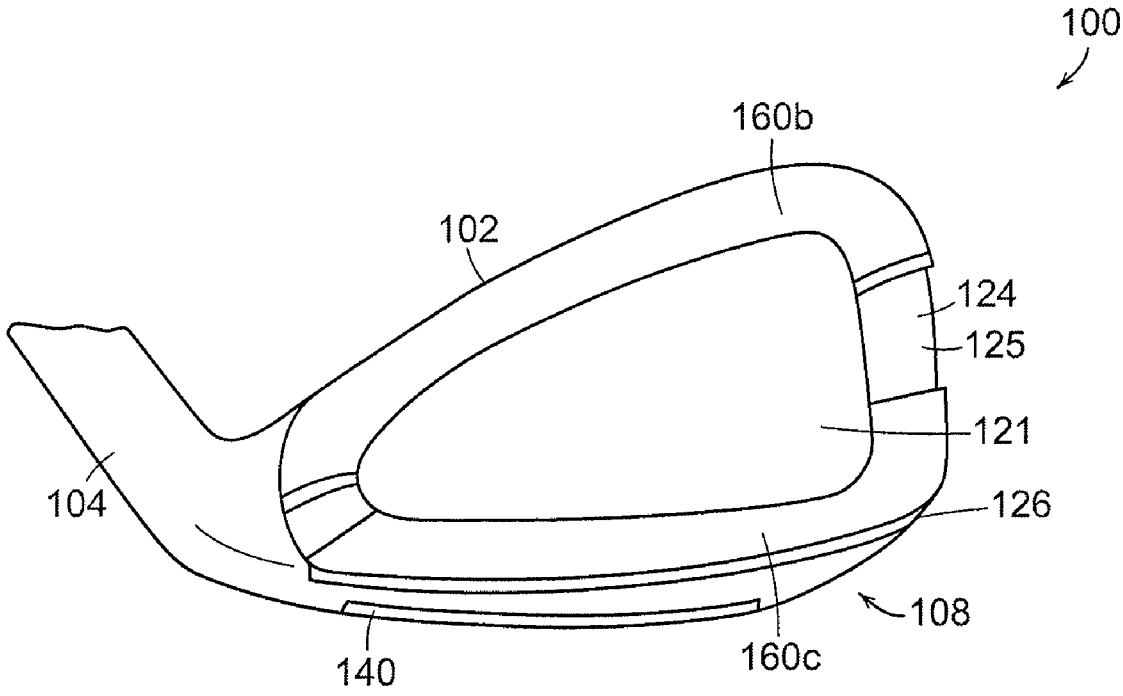
FIG. 9 generally illustrates features of a back view of the golf club structure of FIG. 1 with even another alternative mass member arrangement.

Alternatively, the mass member 160 may extend only part of the way along the perimeter 126. Referring to FIG. 7, the mass member 160*b* is accommodated within the channel 125 adjacent to the peripheral back-surface edge along the top of the body 120. Referring to FIG. 8, the mass member 160*c* is accommodated within the channel 125 adjacent to the peripheral back-surface edge along the bottom of the body 120. By way of another non-limiting example, two or more mass members 160 may be provided, each extending only part of the way along the perimeter 126. Thus, for example, referring to FIG. 9, the mass member 160*b* and the mass member 160*c* may both be accommodated within their respective regions of the channel 125: mass member 160*b* being located in a first region within channel 125 adjacent to the peripheral back-surface edge along the top of body 120, and mass member 160*c* being located in a second region within channel 125 adjacent to the peripheral back-surface edge along the bottom of body 120.

By way of even another non-limiting example (not shown), the mass member 160 may extend completely along the perimeter 126 of the body 120, but only part of the way from the perimeter 126 to the side 125*a* (or vice versa). In other words, if the mass member 160 is located within a channel 125, the mass member 160 need not fill the channel 125. Thus, a person of ordinary skill in the art, given the benefit of this disclosure, would realize that the mass member 160 may be shaped as desired to accommodate the provided mass member mounting configuration of the body 120 and to accommodate the desired mass distribution of the club head 102. Further, as would be apparent to persons of ordinary skill in the art, given the benefit of the present disclosure, the channel or recessed area 125 need not be formed as a single continuous channel, but may be formed from a series of channels having contiguous end or side walls. Thus, by way of non-limiting example, each mass member 160 may be accommodated within a tray-like feature on the back surface.

Figure 11:
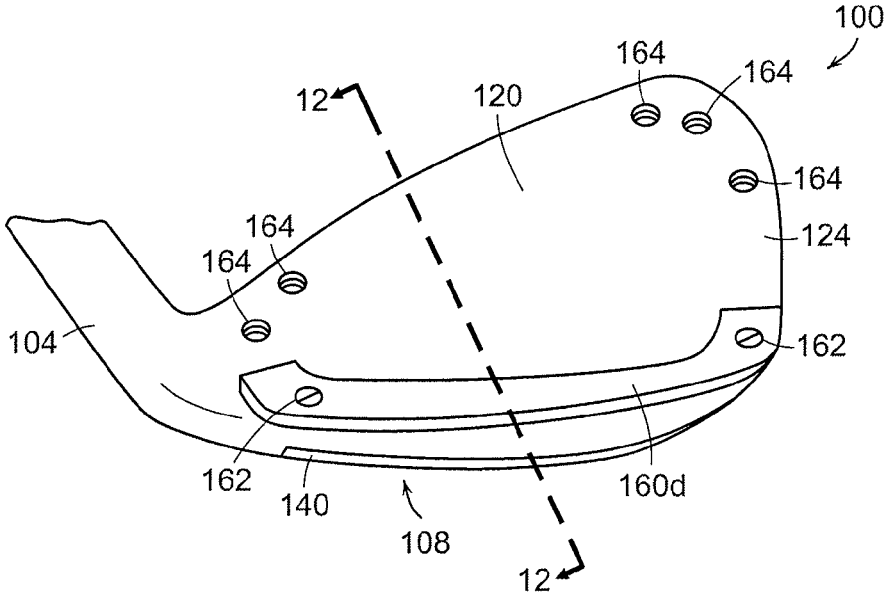
FIG. 11 generally illustrates features of a back view of the golf club structure of FIG. 10 with a first mass member arrangement.
Figure 13:
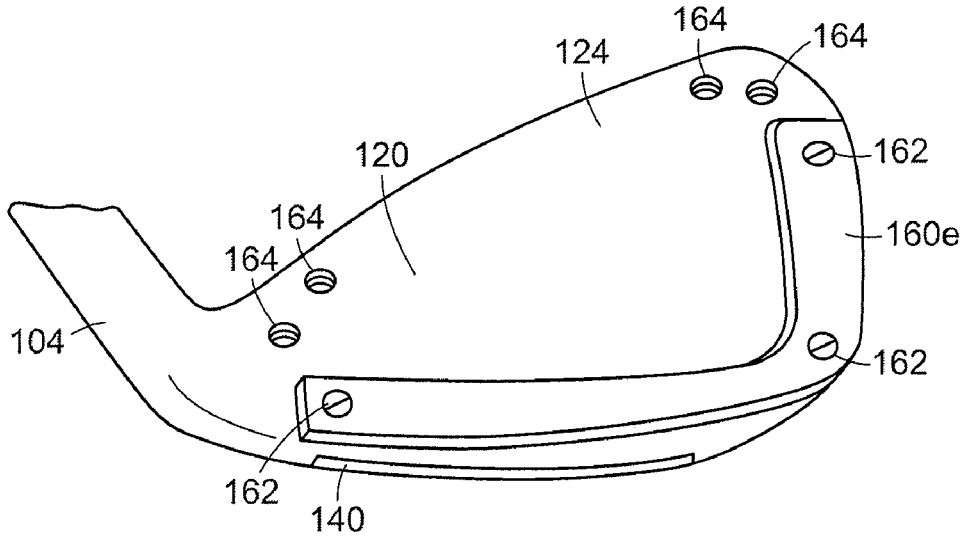
FIG. 13 generally illustrates features of a back view of the golf club structure of FIG. 10 with an alternative mass member arrangement.

As described above, the body 120 is configured to accommodate a first mass member 160 in a first region on the back surface of the body 120, and further is configured to accommodate a second mass member 160 in a second region on the back surface of the body 120. As used herein, the term "region" refers to the area of the back surface of the body that is contacted by the mass member when the mass member is attached to the body. This may also be referred to as an attachment footprint. The first and second regions may be totally distinct or they may partially coincide. For example, referring to FIG. 9, the mass members 160*b* and 160*c* are accommodated within totally distinct regions on the back surface 124 of the body 120. In such an embodiment, both the mass member 160*b* and the mass member 160*c* may be simultaneously accommodated on the back surface of the body 120. Alternatively, referring to FIGS. 2 and 8, the mass member 160*a* and the mass member 160*c* are accommodated with regions that partially coincide. In this example, the region that accommodates mass member 160*c* (see FIG. 8) forms part of the region that accommodates mass member 160*a* (see FIG. 2). The mass members 160*a* and 160*c* may be interchangeable accommodated on the back surface of the body 120. In other words, the mass member 160*a* is detached from the body 120 prior to the mass member 160*c* being attached thereto. As another example, as will be described further herein, the mass member 160*d*, as shown in FIG. 11, and the mass member 160*e*, as shown in FIG. 13, are releasably and interchangeably accommodated within first and second regions that partially coincide or overlap.

The various mass members 160 may have different shapes. Thus, for example, the various mass members 160 may have different footprint shapes, i.e., the shape of the portion of the mass member that contacts the back surface 124 of the body 120. Alternatively, the mass members 160 may have the same footprint shape, but may have different shapes due to differing thicknesses. Even further, the various mass members 160 may have different densities.

A third average density (D3) is associated with the material(s) used to form the various mass members 160. If the mass member 160 is formed of a single material, the average density D3 of the mass member 160 is equal to the density of that material. However, if the mass member 160 is formed of more than one material, the average density D3 of the mass member 160 is calculated as the total mass of the mass member 160 divided by the total volume of the mass member 160. Different mass members 160 may have different average densities, i.e. a first mass member may be formed of tungsten, while a second mass member may be formed of steel.

The various average densities of the body 120, the ball-striking face member 140 and the mass member 160 are used to craft a club head 102 having a desired mass distribution. If a club head were to be unitarily formed of a single material, as in certain prior art, the center of gravity (CG) and the moment of inertia (MOI) of the club head would be purely a function of the shape of the club head. In such an instance, the only way to shift the center of gravity or change the moment of inertia would be by changing the shape of the club head. In the example aspects of club heads described herein, by forming the club head from several components having different average densities, if desired, the center of gravity can be shifted and the moment of inertia can be increased or decreased without changing the overall shape of the club head.

Further, if desired, the center of gravity can be shifted and the moment of inertia can be changed without changing the total weight of the club head—only the weight distribution is changed. Thus, for example, the mass saved by using a ball-striking face member having a lower density that the density of the body may be repositioned toward the back of the club head. This results in a shift of the center of gravity of the club head away from the striking face. For example, if the volume of the lower density face member is the same as the volume of the striking face that it "replaces," then the mass that can be shifted, while maintaining the total weight of the club head the same, is equal to the volume of the ball-striking face member multiplied by the difference between the average density of the body and the average density of the ball-striking face member.

Alternatively, a person of ordinary skill in the art, given the benefit of the present disclosure, would recognize that it is not necessary to maintain the overall shape of the club head or to maintain the total weight of the club head in order to realize the advantages taught by the present application. Specifically, whether or not the shape or the weight of a club head is modified, customizing the weight distribution of the club head may be efficiently achieved by selectively reducing the density of certain club head components, by selectively increasing the density of certain other club head components, and/or by shifting the mass distribution.

Figure 10:
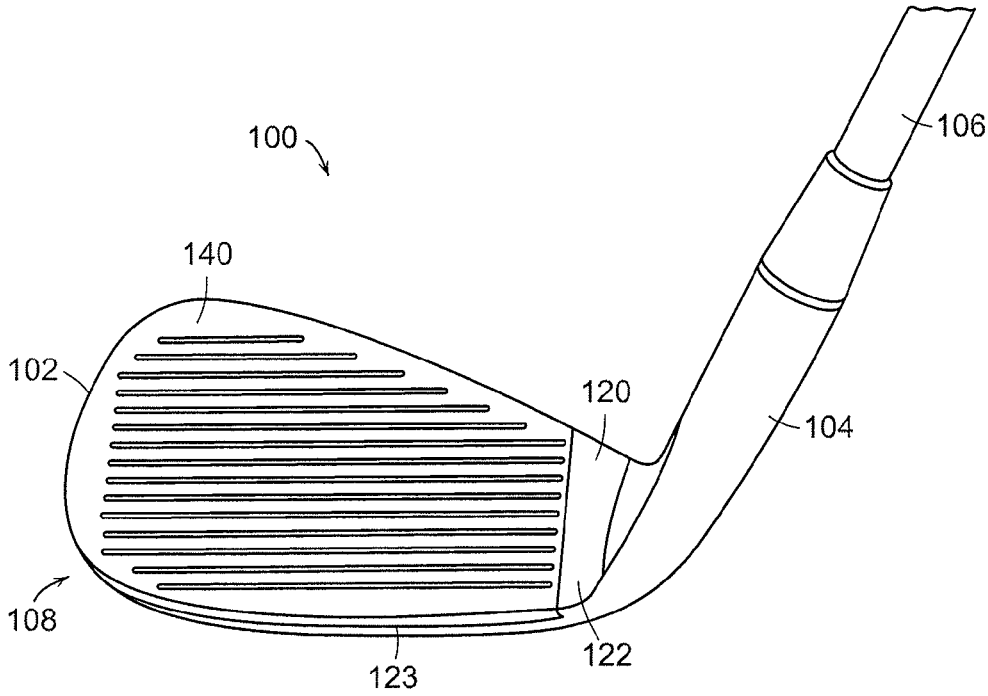
FIG. 10 generally illustrates features of a front view of an iron-type golf club structure according to at least some examples of this disclosure.
Figure 12:
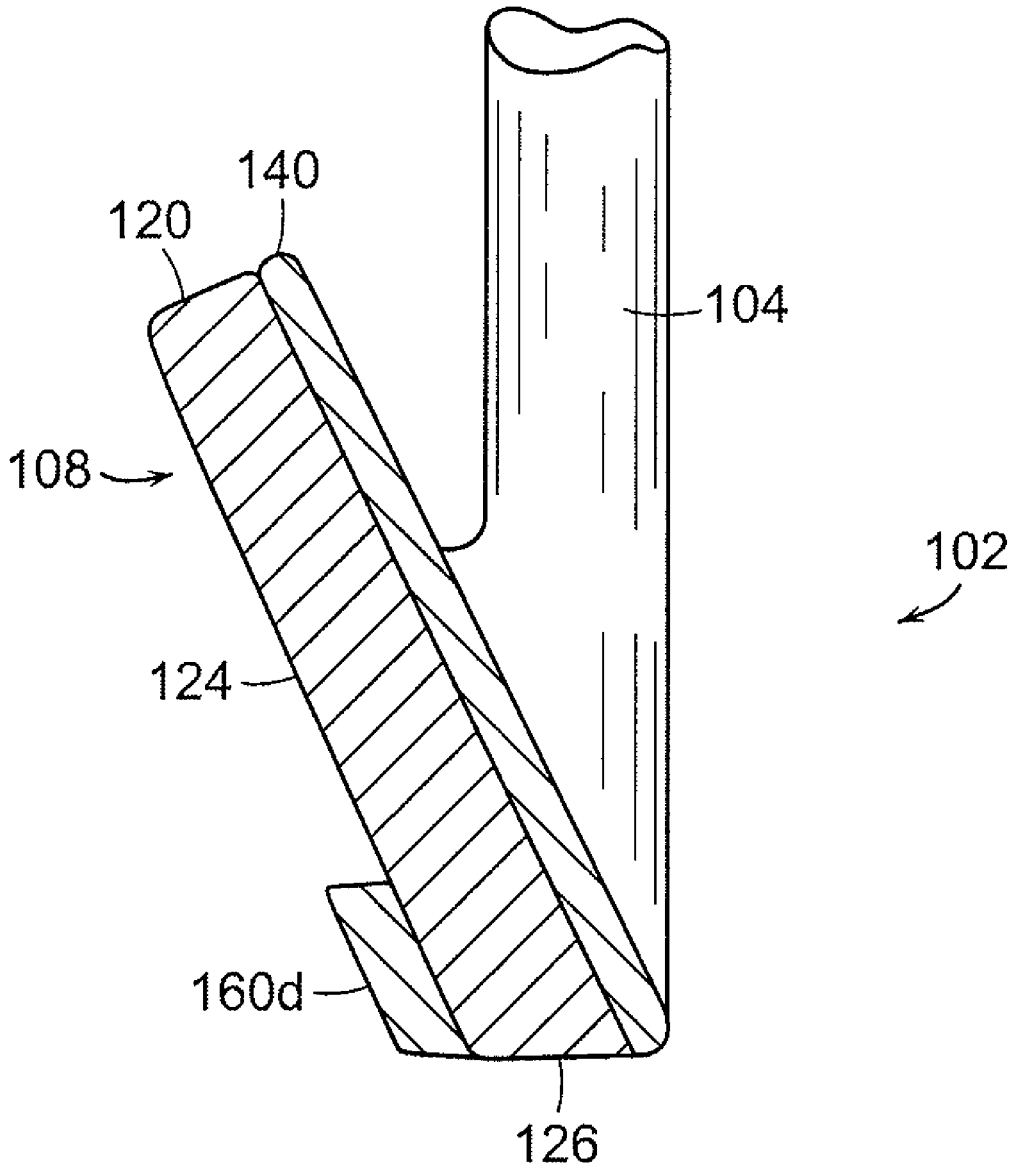
FIG. 12 generally illustrates features of a cross sectional view of the golf club head of FIG. 10.

FIGS. 10-12 illustrate another example of an iron-type golf club 100 and/or golf club head 102 in accordance with the present disclosure. The club head 102 includes the foot structure 108 and the shaft-attachment structure 104.

The foot structure 108 includes the body 120, the ball-striking face member 140, and the mass member 160. The body 120 extends from the shaft-attachment structure 104 in the heel region toward the toe region and defines a front surface 122, a back surface 124 and a perimeter 126.

As best shown in FIGS. 10 and 12, the foot structure 108 further includes the ball-striking face member 140, which is located on the front surface 122 of the body 120. The ball-striking face member 140 in this example embodiment is located within recess 123 and extends from the heel region all the way across the face of the foot structure to the perimeter 126 at the toe.

Referring to FIGS. 11 and 12, a mass member 160*d* is shown attached to the back surface 124 of the body 120. The mass member 160*d* is located adjacent the sole of the body 120 and extends along the bottom peripheral edge of the body 120. Locating the mass member 160*d* toward the bottom edge of body 120 shifts the center of gravity towards the sole of the club head. In this example embodiment, the mass member 160*d* is not located within a channel, but rather is accommodated on a planar surface that defines the back surface 124 of the body 120.

Figure 14:
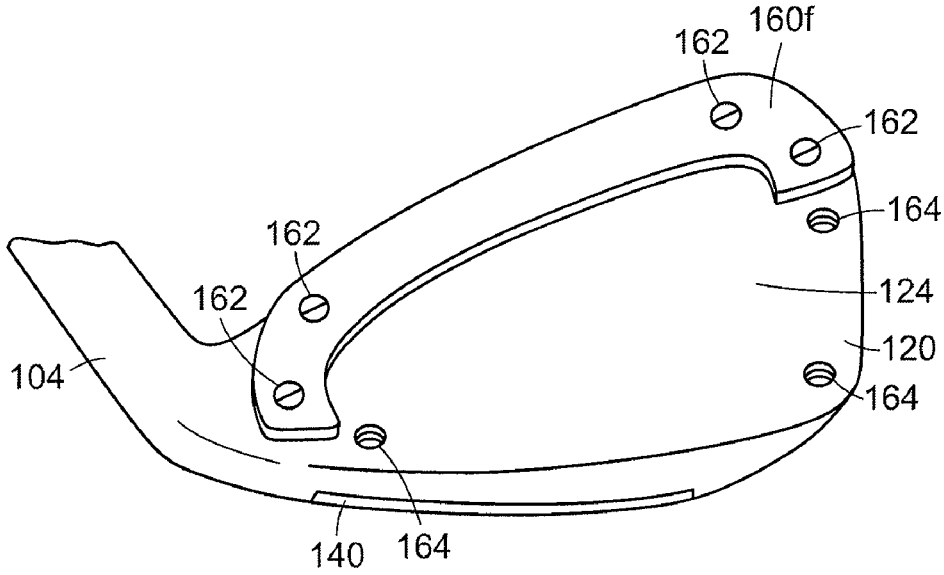
FIG. 14 generally illustrates features of a back view of the golf club structure of FIG. 10 with another alternative mass member arrangement.
Figure 15:
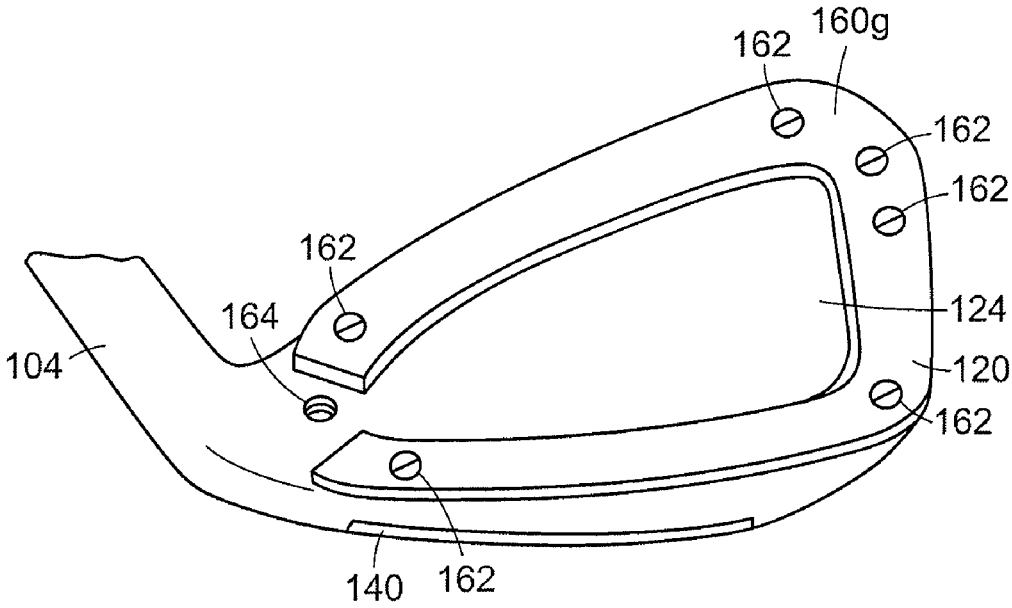
FIG. 15 generally illustrates features of a back view of the golf club structure of FIG. 10 with even another alternative mass member arrangement.

FIGS. 13-15 illustrate alternative placements of other mass members 160*e*, 160*f* and 160*g* on the back surface 124 of the body 120. In FIG. 13, the mass member 160*e* extends along the peripheral bottom edge of the body 120 and continues up along a portion of the peripheral toe edge of the body 120. In FIG. 14, the mass member 160*f* is attached to the planar back surface 124 of the body 120 along the peripheral top edge. In FIG. 15, the mass member 160*g* is shown attached to the planar back surface 124 of the body 120 along the peripheral top, toe and bottom edges. As would be apparent to persons of ordinary skill in the art, given the benefit of this disclosure, other placements and shapes of the one or more mass members may be desirable.

In FIGS. 11, 13-15, the mass members 160*d*, 160*e*, 160*f* and 160*g* are shown releasably attached to the back surface 124 of the body 120 with mechanical fasteners 162. Further, in FIGS. 11 and 13, the body 120 is shown configured to accommodate mass member 160*f* of FIG. 14. Specifically, by way of non-limiting example, the threaded holes 164 provide mass member accommodating features The threaded holes 164, which are configured to receive the fasteners 162, are located adjacent the peripheral back-surface top edge of the body 120. Likewise, in FIG. 14, the body 120 is shown configured to accommodate mass member 160*e* of FIG. 13. In FIG. 14, the threaded holes 164 are located adjacent the peripheral back-surface bottom and toe edges of the body 120 and are configured to accommodate attaching the mass member 160*e* to the body 120. Thus, it can be seen that any of the mass members 160*d*, 160*e*, 160*f* and 160*g* may be attached to the body 120 of FIGS. 10-15 via the fasteners 162 and the threaded holes 164. Further, the mass members 160*d*, 160*e*, 160*f* and 160*g* may be releasably attached to the body 120 using the fasteners 162.

Thus, by way of non-limiting example, a user may have the mass member 160*e* attached to the body 120 as shown in FIG. 13 in order to position the center of gravity up and toward the back of the club head (compared to the weight distribution if the mass member 160*e* was not attached.) Subsequently, if the user were to decide that a lower center of gravity may be more desirable for his swing characteristics, the user could detach the mass member 160*e* from the body 120 and interchangeably attach the mass member 160*f* to the back surface 124 of the body 120 as shown in FIG. 14. Alternatively, any of the mass members 160*d*, 160*e*, 160*f* and 160*g* may also be non-releasably attached to the body 120, using, for example, an epoxy adhesive or fastener locking elements, should the user decide that further interchangeability is not desired.

Figure 17:
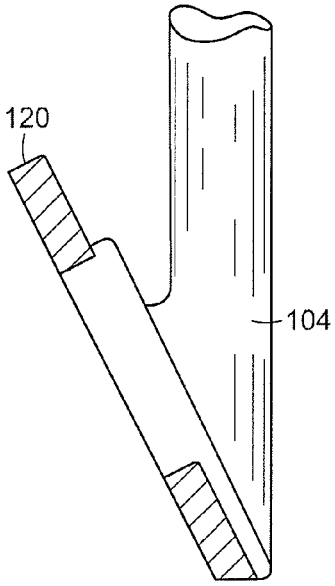
FIG. 17 generally illustrates features of a cross sectional view of the golf club head body of FIG. 16.
Figure 16:
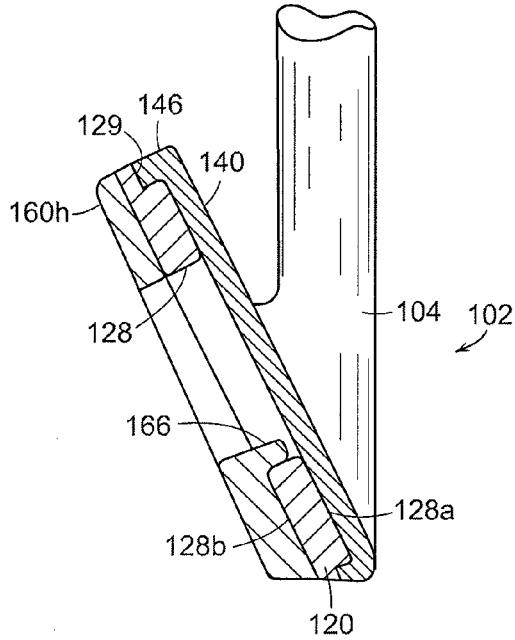
FIG. 16 generally illustrates features of a cross sectional view of a golf club head body according to at least some examples of this disclosure.
Figure 18:
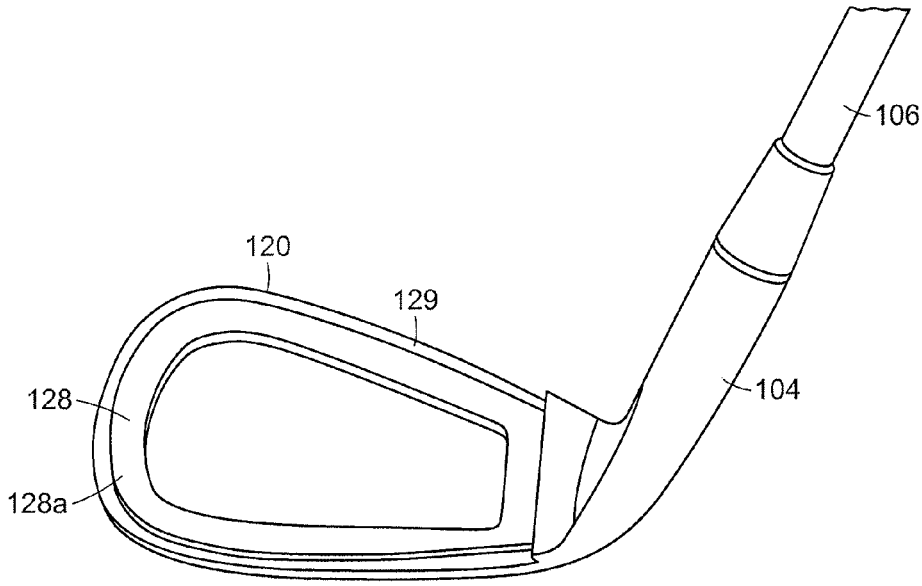
FIG. 18 generally illustrates features of a front view of a golf club head body of FIG. 16.

FIGS. 16-18 illustrate yet another example embodiment of a club head 102, wherein the body 120 is configured as a frame 128. FIG. 16 is a cross-section of a club head 102 having a ball-striking face member 140 and a mass member 160*h* attached to a body 120. FIG. 17 is a cross section of the body 120. FIG. 18 is a front perspective view of the body 120. The ball-striking face member 140 is attached to the front surface 128*a* of frame 128. Furthermore, the ball-striking face member 140 is shown having peripheral edges that form a flange 146. The flange 146 extends over a perimeter portion of frame 128. Thus, in this example embodiment, the ball-striking face member 140 defines a front-surface peripheral edge that extends across the top, down along the toe, and across the bottom edges of the golf club head. The flange 146 may be at least partially seated in channel 129 provided by the body 120. The mass member 160*h* is attached to the back surface 128*b* of frame 128 and extends adjacent to at least substantially the entire peripheral back-surface edge of the body 120. In this example embodiment, the mass member 160*h* includes a flange or lip 166 that at least partially extends into the region framed by the frame 128. The lip 166 may assist in attaching and retaining the mass member 160*h* to the body 120.

Thus, it is shown that a wide variety of overall club head constructions are possible without departing from this disclosure, and that the center of gravity of the club head 102 may be adjusted widthwise (i.e., heel to toe), height-wise (i.e., sole to crown) and/or depth-wise (i.e., face to rear). Different locations of the center of gravity of the club head can affect the trajectory and ball flight of a golf ball struck by the golf club. Hence, it is understood that selecting and combining certain bodies 120 with certain face members 140 and one or more of certain mass members 160 can produce a golf club head 102 with desirable weight distribution characteristics.

For example, the configuration of FIGS. 1-3 shifts weight from the front of the club head to the back of the club head when compared to a solid club head having the same overall volume and a uniform density equal to the density of the body 120. This is because the face member 140 has a lower density than the body 120 and further because the mass member 160 has a greater density than the body 120. This shift in weight results in a shift in the center of gravity toward the back of the club head. Additionally, because weight has been shifted from the center of the club head toward the perimeter of the club head, the moment of inertia of the club head has been increased. As another example, the configuration of FIGS. 10-12 shifts weight from the front of the club head to the back of the club head and toward the sole of the club head. This shift in weight results in a shift in the center of gravity both toward the back and toward the sole of the club head. Additionally, because the lower density ball-striking face member extends all the way to the toe edge, the center of gravity has been shifted toward the heel region of the club head.

If desired, some or all of the various individual parts of the club head 102 described above may be made from multiple pieces that are connected together (e.g., by adhesives or cements; by welding, soldering, brazing, or other fusing techniques; by mechanical connectors; etc.). The various parts (e.g., body 120, ball-striking face member 140, and mass member 160) may be made from any desired materials and combinations of different materials, including materials that are conventionally known and used in the art, such as metal materials, including lightweight metal materials, composite materials, polymer materials, etc., so long as the specific densities are achieved.

Further, the dimensions and/or other characteristics of a golf club head 102 according to examples of this disclosure may vary significantly without departing from the disclosure. For example, any iron-type club head may be provided including, for example: iron-type hybrid clubs, driving irons, 0 through 10 irons, wedges (e.g., pitching wedges, lob wedges, gap wedges, sand wedges, etc.), chipping clubs, etc. Additionally, iron-type golf club heads in accordance with examples of this disclosure are not limited to the traditional "blade" type clubs or to the "cavity-back" type clubs. Rather, if desired, other iron-type golf club head structures may be formed in accordance with this disclosure.

Further, if desired, in accordance with at least some examples of this disclosure, golf clubs and/or golf club heads in accordance with examples of this disclosure may be sold or marketed as a set including plural irons, including, for example, sets having two or more of iron type hybrid clubs, driving irons, 0-10 irons, pitching wedges, lob wedges, sand wedges, gap wedges, and/or chipping clubs.

Finally, it is noted that the specific club head components discussed in detail above are merely examples of components that may be used in accordance with this disclosure and are not meant to constitute an exhaustive list. Indeed, these illustrative examples are simply intended to provide the reader with a better understanding of the disclosure.

III. CONCLUSION

The present disclosure is described above and in the accompanying drawings with reference to a variety of example structures, features, elements, and combinations of structures, features, and elements. The purpose served by the disclosure, however, is to provide examples of the various features and concepts related to the disclosure, not to limit the scope of the disclosure. One skilled in the relevant art will recognize that numerous variations and modifications may be made to the embodiments described above without departing from the scope of the present disclosure, as defined by the appended claims.

We claim:

1. A head for an iron-type golf club comprising:

an iron-type body extending from a shaft-attachment structure, the iron-type body having a first average density; and a ball-striking face member located on a front surface of the iron-type body, the ball-striking face having a second average density that is less than the first average density;

a first mass member releasably attached on a back surface of the iron-type body adjacent to substantially an entire back-surface peripheral bottom edge of the iron-type body, a second mass member releasably attached on the back surface of the iron-type body adjacent to substantially an entire back-surface peripheral top edge of the iron-type body, wherein the back surface of the iron-type body includes a raised central portion and a raised heel portion both raised toward a rear of the body relative to the back-surface peripheral edge, and wherein at least one of the first and second mass members is releasably attached between the raised central portion and the raised heel portion.

2. The head for the iron-type golf club according to claim 1, wherein the iron-type body is configured to releasably accommodate first and second mass members having different shapes.

3. The head for the iron-type golf club according to claim 1, wherein the first average density is less than an average density of the first mass member.

4. The head for the iron-type golf club according to claim 1, wherein the first mass member has a third average density that is greater than the second average density.

5. The head for the iron-type golf club according to claim 1, wherein the back surface of the iron-type body includes at least one channel extending along the peripheral back-surface edge of the iron-type body, and wherein the at least one channel is configured to accommodate the first and the second mass members at least partially within the channel.

6. The head for the iron-type golf club according to claim 1, wherein the ball-striking face member forms at least a portion of a front-surface peripheral edge of the head.

7. A golf club comprising:

an iron-type golf club head according to claim 1; and a golf club shaft attached to the iron-type golf club head.

8. The head for the iron-type golf club according to claim 1, wherein the raised central portion of the iron-type body is integrally formed with the remainder of the iron-type body.

* * * * *